US006964532B1

(12) United States Patent
Lu

(10) Patent No.: US 6,964,532 B1
(45) Date of Patent: Nov. 15, 2005

(54) KEY ARRAY STRUCTURE

(75) Inventor: Ming Hsing Lu, Hsinchu (TW)

(73) Assignee: Lite-On It Corporation, Taipei (TW)

( * ) Notice: Subject to any disclaimer, the term of this patent is extended or adjusted under 35 U.S.C. 154(b) by 0 days.

(21) Appl. No.: 10/916,465

(22) Filed: Aug. 12, 2004

(30) Foreign Application Priority Data

May 24, 2004 (TW) ..... 93208129 U

(51) Int. Cl.[7] ..... B41J 5/00

(52) U.S. Cl. ..... 400/490; 400/491; 400/491.2; 200/5 A; 200/341; 200/345

(58) Field of Search ..... 400/472, 490, 400/491, 491.2; 200/5 A, 5 B, 341, 345; 341/34

(56) References Cited

U.S. PATENT DOCUMENTS 5,932,854 A * 8/1999 Umemura ..... 200/5 B
6,755,582 B2 * 6/2004 Won ..... 400/490
6,776,547 B1 * 8/2004 Dubois et al. ..... 400/496

* cited by examiner

*Primary Examiner*—Ren Yan
*Assistant Examiner*—Dave A. Ghatt
(74) *Attorney, Agent, or Firm*—Birch, Stewart, Kolasch & Birch, LLP

(57) ABSTRACT

A key array structure comprises a key array constituted by connecting a plurality of key members arranged in an array, it is characterized in that an elastic element is connected between each two adjacent key members and a positioning hole or position holes is or are disposed in the key member. The elastic member disposed between each two adjacent key members of the key array structure according to the present invention has a cushioning effect to adjust the deformation of the key array caused from the processes such as heat baking while manufacturing so as to allow the positioning hole in each key member to be precisely positioned with a corresponding position pin on a relative member.

9 Claims, 6 Drawing Sheets

KEY ARRAY STRUCTURE

This Non-provisional application claims priority under 35 U.S.C. § 119(a) on Patent Application No(s). 093208129 filed in Taiwan, Republic of China on May 24, 2004, the entire contents of which are hereby incorporated by reference.

BACKGROUND OF THE INVENTION

1. Field of the Invention

The present invention relates to a key array structure, and more particularly to a key array in which an elastic member is disposed between each two keys to adjust the deformation yielded from manufacturing process such as hot baking to allow a positioning hole on each key member to be able to be accurately coupled with a positioning pin on a relative member.

2. Description of Related Art

Function keys used on electronic machines such as a video recorder/player, CD player and DVD recorder/player are always designed to be a function key array structure for being matched up with the model and the outlook of such facilities. These keys are assembled one by one in the earlier time. But, a key structure capable of integrating keys into one body and assembling by one set is currently developed to attain to the assembly of all keys in one time accompanying the progress of plastic molding technology and the consideration of convenience and labor cost in manufacturing so as to save the labor cost and the assembly time and further to lower the production costs of such kinds of facilities.

A position hole, as FIG. 1 shows, is disposed between each two adjacent keys in a conventional key array structure for precise positioning while assembling. However, only an precise positioning hole shown as an element 11 in FIG. 1 is disposed in an key array structure for a general positioning design thereof, and this precise positioning hole is usually in the middle of the key array and the rest of positioning holes are long holes shown as an element number 12 in FIG. 1; the long hole positioning is only an auxiliary but not accurate positioning. The key array structures are mostly made from a manufacturing process such as plastic injection forming. The deviation of the positioning hole is possibly caused from a manufacturing error when the key array is manufactured or a paint such as pigment or a metal layer needed to coat or plate on the key array for increasing artistic quality or product value and a baking process needs to be practiced thereon at this time. The heat participated in the baking process could cause the key array to be deformed a little to induce the deviation of the positioning hole. The tolerance becomes larger when the position hole is farer away from the central accurate positioning hole. The accumulations of the error on the manufacturing of the key array mentioned above and the tolerance mentioned above causes the deviation of the key so that a uneven gap could formed between it and the positioning hole.

SUMMARY OF THE INVENTION

The present invention relates to a key array structure, mainly comprises a key array constituted by connecting a plurality of key members in an array, in which an elastic element is inserted between each two adjacent keys to connect them together and each key member is constituted by a fixing rack, key main body and key seat. The key seat is connected to the fixing rack through at least one elastic arm so that pressing-down and rebounding forces can be provided through the deformation of the elastic arm when the key member is pressed down. A positioning hole is disposed in the fixing rack for accepting a positioning pin on a relative member to process an accurate positioning. A projecting post is disposed at the opposite side of the key seat and the seat main body and a guide notch used to prevent the key from heeling is disposed approximately in the middle of a side of the key seat above or below the key main body or both of them for being connected with a raise mass on the corresponding member.

A key array structure according to the present invention is characterized in that each two adjacent key members are connected through an elastic element; the elastic element can be functioned as a buffer under a circumstance that a key array is caused to deform slightly when the key array is manufactured by injection forming so as to adjust properly a distance error formed between the position hole disposed in each key member and the corresponding position pin in the relative member caused from the deformation owing to the control of manufacturing conditions to allow the positioning hole in each key array structure according to the present invention to be able to be precisely positioned with the corresponding positioning pin.

Besides, each two adjacent key members according to the present invention are connected through an elastic element; a plurality of corresponding positioning pins can be disposed on a relative member to insert into positioning holes disposed in the key member to fix each other so as to solve the problem of the uneasy control of the interval between two key members caused from the deviation of the position hole in a conventional key array.

Along hole type auxiliary positioning hole can further disposed in a fixing rack of a key array structure according to the present invention besides a positioning hole so as to boost the stable positioning for the key member. For avoiding the dimension error caused from the heat participated in the manufacturing of the key array, the auxiliary positioning hole is designed to be a long hole type to tolerate the error.

A projecting post is disposed on the opposite of the key main body on each key seat in a key array structure according to the present invention is used to prop against a IC plate to prevent the key from being elastically deformed after frequent and numerous pressings.

For further preventing the key from being elastically deformed after numerous pressings, a projecting post can also be disposed at a proper position on the elastic element mentioned above besides the projecting post is disposed on the key seat and the opposite side of key main body to assist the fixation of the key and prevention of the elastic deformation.

A positioning hole can further be disposed in the bottom of the U type member, i.e. the circular arc of the U type member to bring a further positioning function when a positioning pin is disposed at a corresponding position on the relative member. But, the projecting post and the positioning hole in the elastic element of the key array structure according to the present invention are optional.

Besides, a guide notch is disposed on the key seat at a side of the key seat below or above the key main body or both of them in the key array structure according to the present invention. The guide groove is corresponding to the raised mass on the relative member so as to be engaged with the raised mass to prevent the key from heeling.

The distance between each two adjacent keys and the number of the keys are not particularly limited in the key array according to the present invention. And, whether the distance between each two adjacent keys is equal is also not limited. They are decided by the final purpose such as the design of a video/audio player and the number of needed function keys.

By the way, the relative member mentioned above means an operation panel on the video/audio player or something else.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
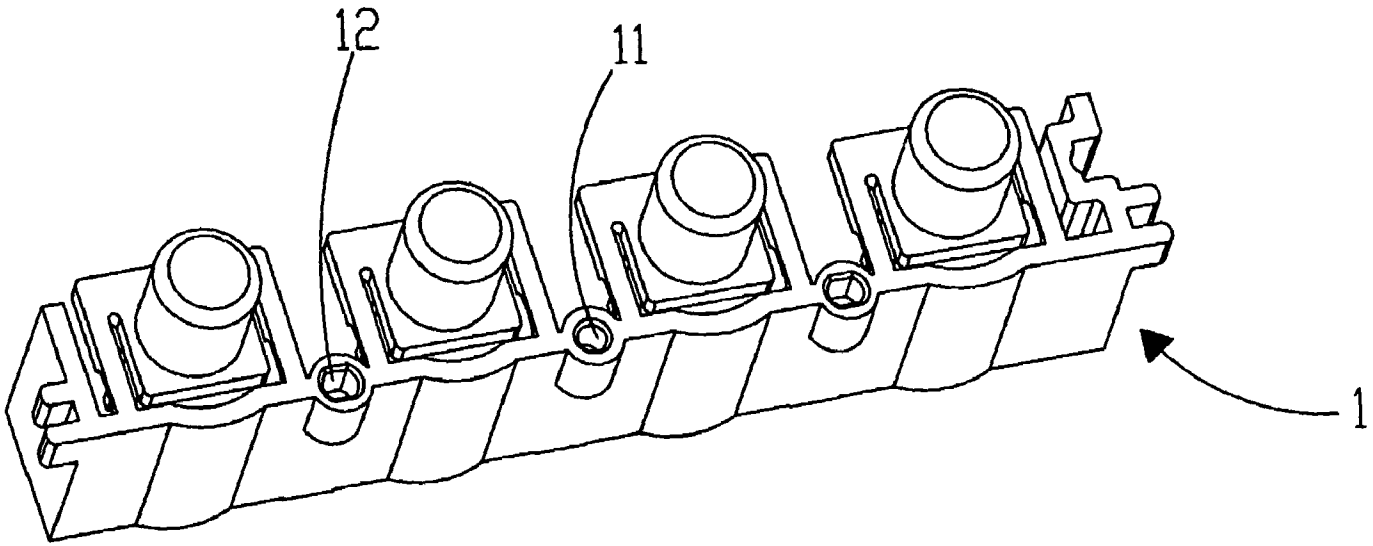
Fig. 1 PRIOR ART
FIG. 1 is a schematic view, showing a key array structure of the prior art.
Figure 2:
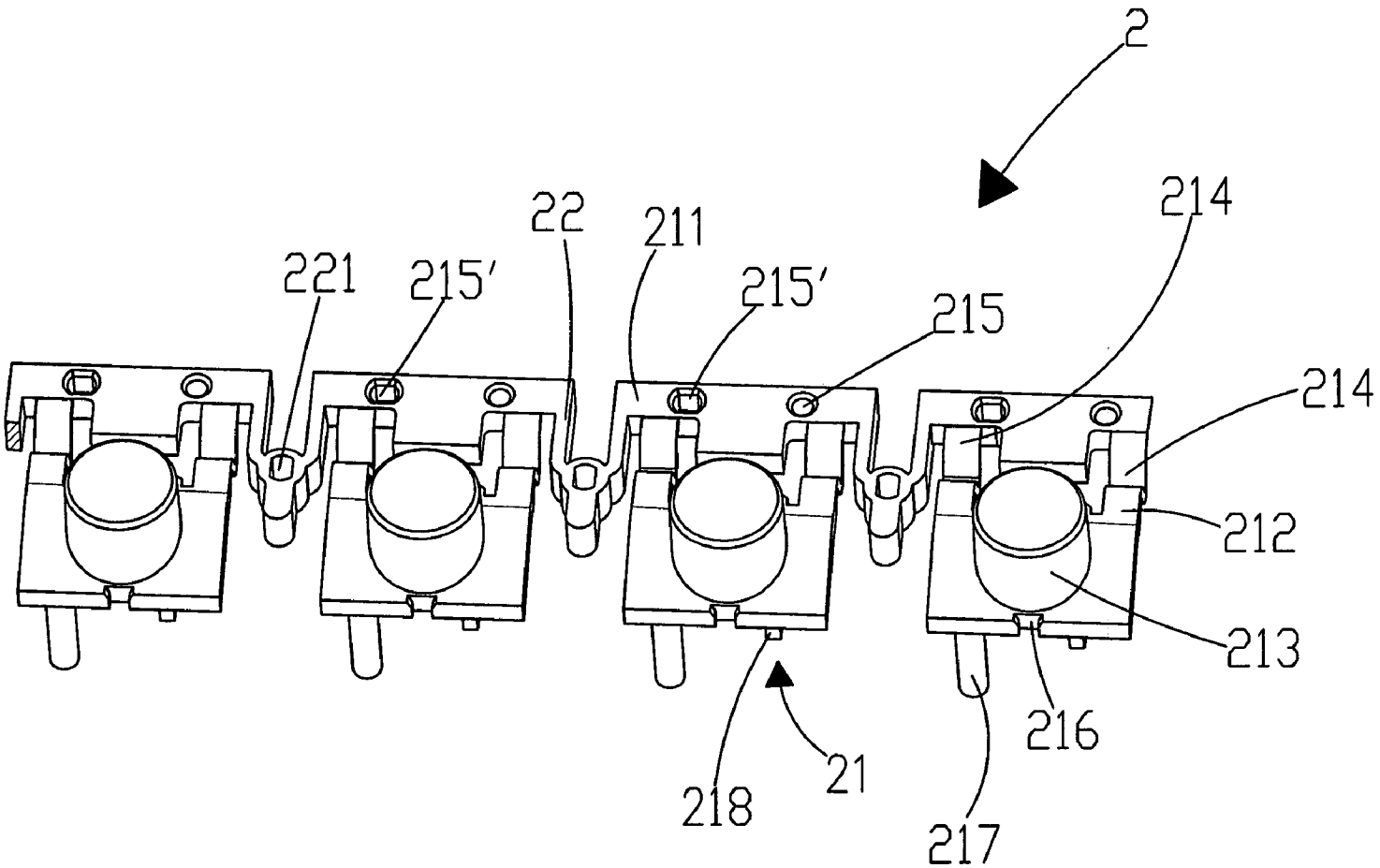
FIG. 2 is a schematic view, showing a key array structure of a preferred embodiment according to the present invention.

Please refer to FIG. 2. FIG. 2 is a front schematic view, showing a key array structure of a preferred embodiment according to the present invention. For clarity in description, a positioning hole and an auxiliary positioning hole are disposed in each key member in the figure. A key array 2 is constituted by a plurality of key members 21 and an elastic element 22 connected between each two adjacent key members, in which the key member comprises a fixing rack 211, key seat 212 and key main body 213, in which each key member is connected to the fixing rack through two elastic arms 214 and to provide an elastic force to press down or rebound the key main body 213 owing to the deformation of the elastic arms 214 when the key main body 213 is pressed, a positioning hole 215 and auxiliary hole 215', a guide notch 216 is disposed on the key seat 212 approximately in the middle of a side of the key seat 212 below the key main body 213 and a projecting post 217 and pressing element 218 are disposed on the key seat 212 and at the opposite side of the key main body 213. The projecting post 217 is propped against a circuit board (not shown in the figure) located at the rear of the key array 2 to provide a supporting force to prevent the key from being permanently deformed owing to the elastic fatigue of the key when the key is pressed and the pressing element 218 is contacted with a driving unit (not shown in the figure) on the circuit board to actuate the function that the key stands for when the key is pressed. A projecting post (not shown in FIG. 2, but can be seen in FIG. 5) can also be disposed on the fixing seat 211 and at the opposite side of the key main body 213 for propping against the circuit located at the rear of the key array 2 to provide a supporting force. A positioning hole 221 is disposed in the center of the elastic element 22 and can also be inserted into a corresponding positioning pin disposed on the relative member.

Figure 3:
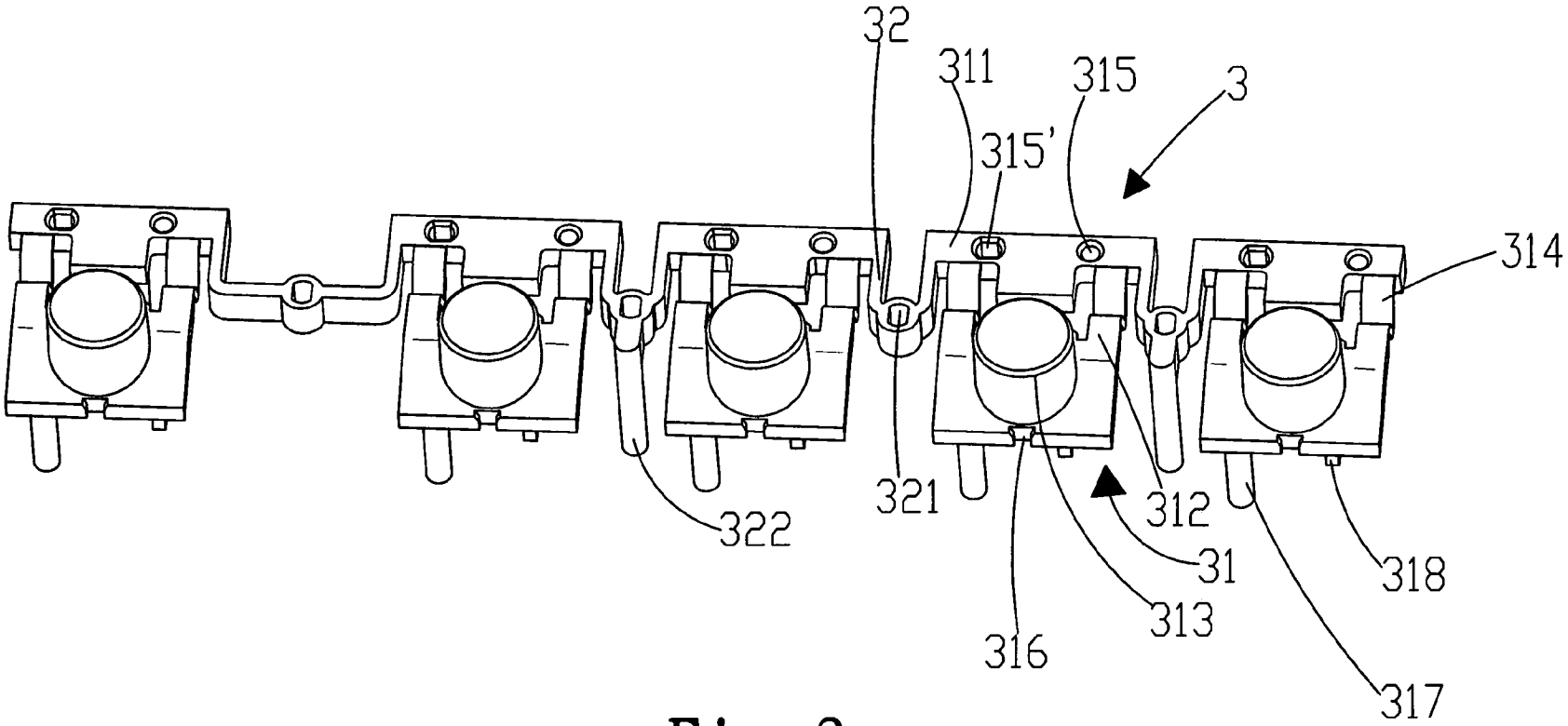
FIG. 3 is a schematic view, showing a key array structure of another preferred embodiment according to the present invention.

Next, please refer to FIG. 3. FIG. 3 is a schematic view, showing a key array structure of another preferred embodiment according to the present invention. From the figure, a positioning hole, auxiliary positioning hole, a key seat on which two guide notches are formed are disposed on each key member and an elastic element with a projecting post thereon is disposed between each two adjacent key members. A key array structure 3 comprises a plurality of key members 31 in which an elastic element 32 is connected between each two adjacent key members 31. The key member 31 is constituted by a fixing rack 311, key seat 312 and key main body 313. The key seat 312 is connected to the fixing rack 311 through two elastic arms 314 that provides a elasticity for pressing down and rebounding the key main body 313 by an elastic force yielded from the deformation of the elastic arms when the key main body is pressed. A positioning hole 315 and auxiliary positioning hole 315' are disposed in the fixing rack 311, a guide notch 316 is disposed approximately in the middle of one side of the key seat 312 below the key main body 313 and a projecting post 317 and a pressing element 318 are disposed on the key seat and at the opposite side of the key main body 313. The projecting post 317 is propped against a circuit board (not shown in the figure) at the rear of the key array 3 after the key is pressed for providing a supporting force to prevent the key from being permanently deformed owing to an elastic fatigue and the pressing element 318 is contacted with an actuator unit (not shown in the figure) on the circuit board to actuate the function that the key stands for when the key is pressed. Besides, a projecting post 319 (please refer to FIG. 5) can also be disposed on the fixing seat 311 and at the opposite side of the key main body 313 for propping against the circuit board at the rear of the key array 3 to provide a fixation supporting force therefore. A positioning hole 321 and projecting post 322 are disposed at the center of the elastic element 32; the positioning hole 321 can be inserted by a corresponding positioning pin disposed on the relative member and the projecting post 322 can be propped against the circuit board to provide a fixing force for the key array 3.

The projecting post 322 mentioned above can be optionally disposed on all or a part of the elastic elements 32. For example, it can be disposed in every other elastic element 32.

Figure 4:
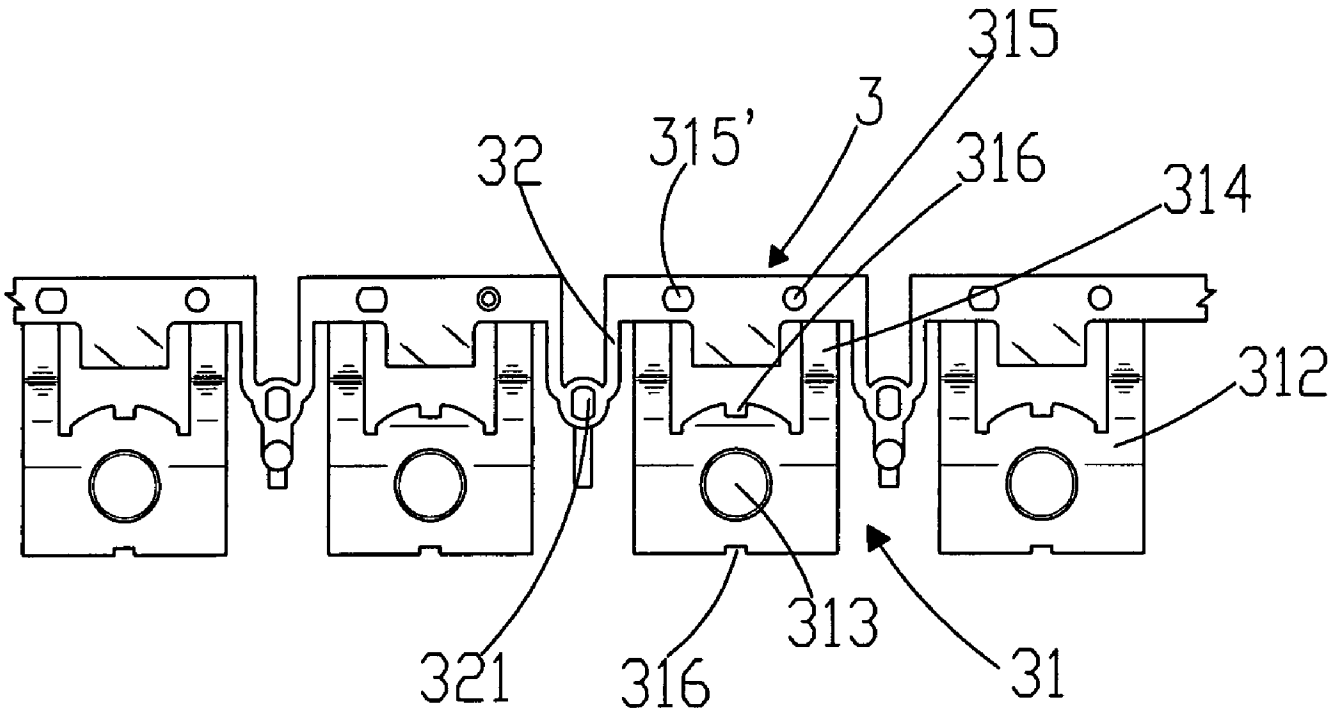
FIG. 4 is a top view, showing a key array structure shown in FIG. 3.

FIG. 4 is a top view showing a part of key members of the key array shown in FIG. 3. The figure is used to show two guide notches 316 and 316 disposed on each key seat 312 approximately in the middle thereof above and below the key main body 313.

Figure 5:
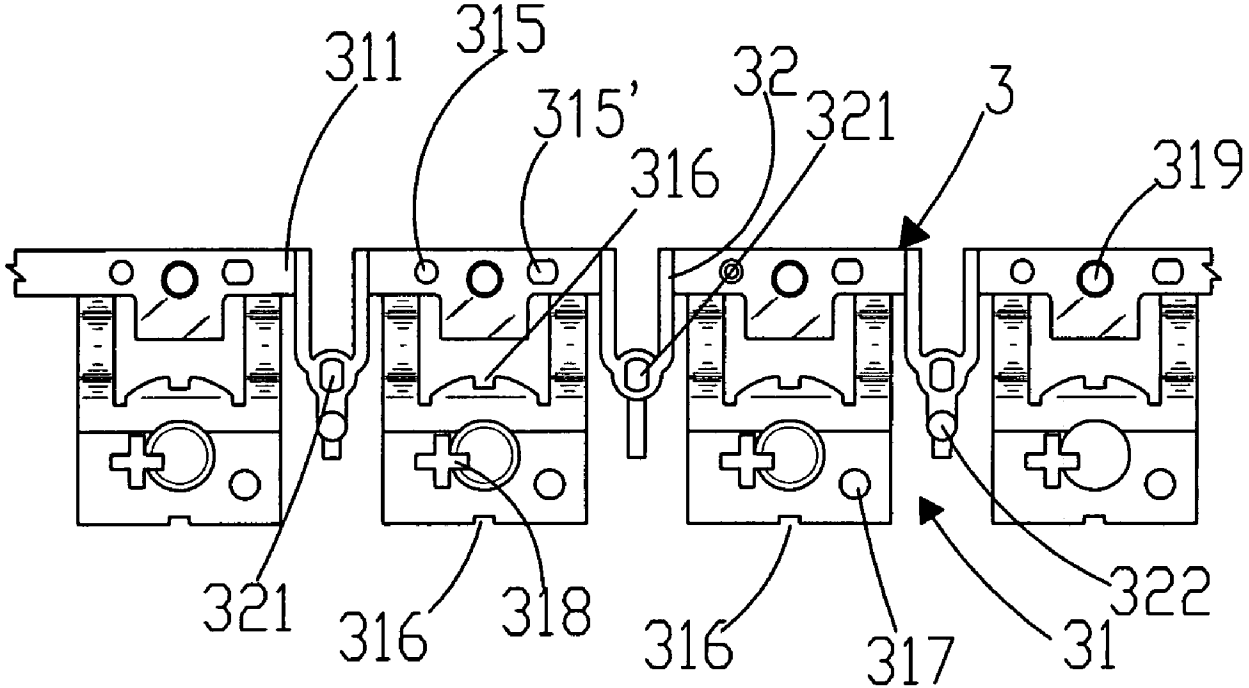
FIG. 5 is a bottom view, showing a key array structure shown in FIG. 3.

FIG. 5 is a rear view showing a part of key members of the key array shown in FIG. 3. The figure is used to show the projecting post 319 disposed on the rack 311 and the opposite side of the key main body 313 and the projecting post 317 and pressing element 318 disposed on the key seat 312 and at the opposite side of the key main body 313.

Figure 6:
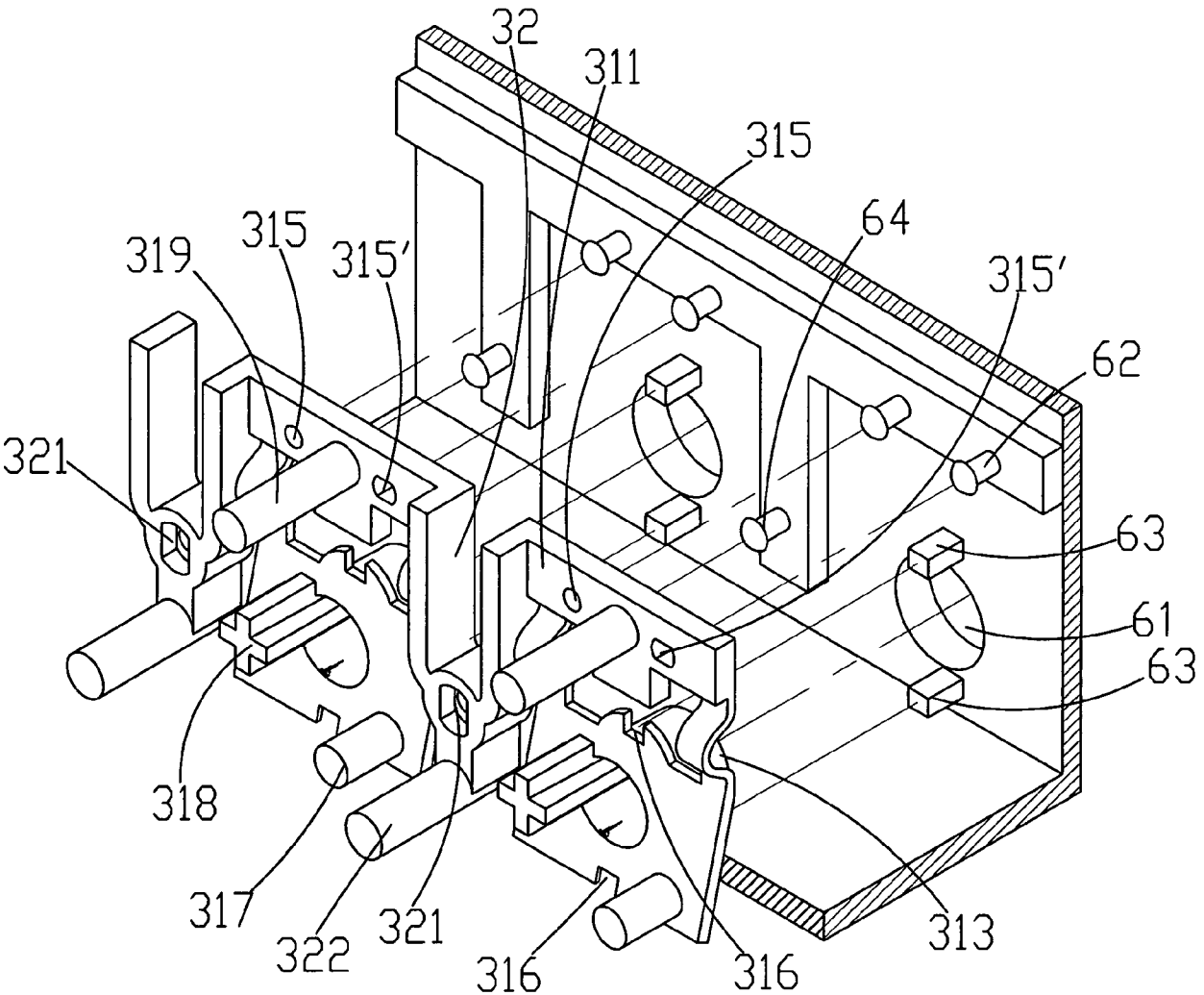
FIG. 6 is a cross sectional view, showing a combination of a relative member and a key array structure of the preferred embodiment of the present invention shown in FIG. 3 after assembly.

FIG. 6 is a cross-sectional view showing the key array structure of the preferred embodiment according to the present invention and the relative member after assembly shown in FIG. 3. When the key array structure 3 is assembled to the relative member 6, the key main body 313 is passed through the key hole 61 in the relative member 6 and the key array structure 3 and the relative member 6 are fixed together by inserting the positioning pins 62 into the positioning hole 315 and the auxiliary positioning hole 315' on each rack 311. In addition, the positioning hole 321 disposed on the elastic element 32 is also inserted by the positioning pin 64 disposed on the relative member 6 and the raised masses 63 disposed on the relative member 6 are engaged with the guide notches 316 on the key seat 312. When the key is pressed, the guide notch is moved to and fro on the raised mass 63 so that the heeling of the key can be prevented. The key array structure according to the present invention can be positioned precisely and fixed by inserting the positioning pin on the relative member into the positioning hole in the key array structure. Moreover, each positioning hole can be precisely positioned and inserted to fix with the positioning pin through the cushioning adjustment of the elastic element disposed in the key array structure even if the deviation of the positioning hole caused by the heat deformation in the manufacturing of the key array structure according to the present invention.

It is noted that the key array structure described above is the preferred embodiments of the present invention for the purpose of illustration only, and are not intended as a definition of the limits and scope of the invention disclosed. Any modifications and variations that may be apparent to a person skilled in the art are intended to be included within the scope of the present invention.

What is claimed is:

1. A key array structure, comprising a key array constituted by a plurality of key members arranged in an array and an elastic element connected between each two said adjacent key members, wherein each said key member comprises a fixing rack, key main body and key seat, said key seat is connected with said fixing rack through at least one elastic arm for providing pressing-down and rebounding forces caused from the deformation of said elastic arm when the key member is pressed, a positioning hole is disposed in said fixing rack for being positioned precisely with a corresponding positioning pin on a relative member and a projecting post is disposed on said key seat and the opposite side of said key main body and a guide notch for preventing said key from heeling is disposed on said key seat and adjacent to said key main body for being connected with a corresponding raised mass disposed on said relative member.

2. The key array structure according to claim 1, wherein said elastic element is a U type element.

3. The key array structure according to claim 1, wherein a positioning hole is further disposed on said elastic element.

4. The key array structure according to claim 1, wherein a projecting post is further disposed on said elastic element.

5. The key array structure according to claim 1, wherein an auxiliary positioning hole is further disposed on said fixing rack.

6. The key array structure according to claim 1, wherein said guide notch disposed on said key seat is located approximately in the middle of one side thereof below said key main body.

7. The key array structure according to claim 1, wherein said guide notch disposed on said key seat is located approximately in the middle of another side there of above said key main body.

8. The key array structure according to claim 1, wherein said guide notches disposed on said key seat are located approximately in the middle of two sides thereof respectively below and above said key main body.

9. The key array structure of claim 1, wherein said relative member is an operation panel of a video/audio player/recorder.

* * * * *